US011524877B2

(12) United States Patent
Webster

(10) Patent No.: US 11,524,877 B2
(45) Date of Patent: Dec. 13, 2022

(54) ELEVATOR SAFETY MECHANISM

(71) Applicant: Robert Webster, Porter, TX (US)

(72) Inventor: Robert Webster, Porter, TX (US)

( * ) Notice: Subject to any disclaimer, the term of this patent is extended or adjusted under 35 U.S.C. 154(b) by 22 days.

(21) Appl. No.: 17/121,748

(22) Filed: Dec. 14, 2020

(65) Prior Publication Data

US 2021/0179389 A1 Jun. 17, 2021

Related U.S. Application Data

(60) Provisional application No. 62/947,973, filed on Dec. 13, 2019.

(51) Int. Cl.
*B66B 13/18* (2006.01)

(52) U.S. Cl.
CPC ..... *B66B 13/18* (2013.01)

(58) Field of Classification Search
CPC ..... B66B 13/12; B66B 13/18; B66B 13/16
See application file for complete search history.

(56) References Cited

FOREIGN PATENT DOCUMENTS

| | | | | |
|---|---|---|---|---|
| EP | 1110900 A1 * | 6/2001 | ..... | B66B 13/16 |
| EP | 3255006 A2 * | 12/2017 | ..... | B66B 13/14 |
| JP | 07309567 A * | 11/1995 | | |
| KR | 20140143181 A * | 12/2014 | | |

OTHER PUBLICATIONS

Machine translation of KR 20140143181.*

* cited by examiner

*Primary Examiner* — Diem M Tran
(74) *Attorney, Agent, or Firm* — Phillip Black; Dossey & Jones PLLC

(57) ABSTRACT

The disclosure provides an apparatus and mechanism for and elevator safety mechanism. The safety mechanism can include a lock bar, a beak assembly, a detector assembly, and a linkage rod providing communication between the beak assembly and the detector assembly. The beak of the beak assembly can engage a catch in the lock bar when the safety mechanism is in a closed position, preventing the doors of the elevator from further opening.

7 Claims, 10 Drawing Sheets

ELEVATOR SAFETY MECHANISM

CLAIM OF PRIORITY

Priority is hereby claimed to U.S. provisional patent application having the Application No. 62/947,973, filed on Dec. 13, 2019, and titled "Elevator Safety Mechanism." Accordingly, all disclosures made in the 62/947,973 application are hereby incorporated by reference.

BACKGROUND OF INVENTION

Field of the Invention

This application relates to a door restraint mechanism for an elevator car. More particularly, this application relates to mechanism to restrict the elevator car doors from opening while outside of a predetermined zone using a "no contact" detector assembly.

Description of Related Art

In the current systems, elevator doors include inadequate, failing, or are completely missing mechanical elements that keep the elevator car doors closed when the elevator is not at a floor of the building. Many of these safety mechanisms that do exist reply on electronic functions, relays, and detectors to function properly. Those electronic features often rely on batteries or other unreliable electric power to function, and when the electric power supply is severed or totally lost, the elevator doors are unable to be opened even if the car is in the leveling zone, rendering the elevator operative.

Another type of door restraint uses a solid vane which is typically in the form of a piece of (often spring loaded) steel mounted to the elevator car door. On the hoist way are strategically mounted steel tabs that contact the steel vane of opening of the car doors is attempted too far above or below the floor level.

Another type uses a moving vane on the car doors that unlocks the doors only when the car is approximately level with the floor. This is accomplished when the elevator stops at a floor and the car door opens, the car door vane pushes against one of the rollers, tripping the hoist way door lock open and moves the hoist way door with the car door. Because this type of system requires contact to activate the open and close function of the door, the system is often noisy and unpleasant for elevator riders or others nearby. These contact vane type safety systems are bulky and add significant weight to the elevator doors, which requires the door speed to slow down.

The new safety system disclosed herein is lighter and lets you run the doors faster, increasing speed of the system. Additionally, the disclosed safety system requires no contact between the for any hoist way device. So, brackets on the rails at the landing zone and/or mounted devices on the elevator car.

In recent years there have been numerous accidents where passengers, trapped in elevator cars, tried to get out of the car by pulling open the car doors and then unlocking and opening the hoist way doors. These passengers often fell under the elevator car in the space created below the car and above the hallway sill and down the elevator shaft (or just falling the distance to the hallway floor). This prompted safety code officials to require that the car doors be locked if the car is outside the leveling or door zone of the elevator car.

Since the doors are required by current codes to be pulled open manually in the car is safely located within the leveling zone, a need exists for a safety mechanism to lock the car doors only if the car is not in the leveling zone.

SUMMARY OF THE INVENTION

The disclosed device uses an adjustable zone target and one or more magnets mounted in a detector arm to detect the leveling zone of an elevator car. Once in the target zone, the elevator doors are unlocked and the elevator doors are allowed to open. The disclosure uses a beak assembly, which is linked to the detector arm, to lock and unlock the elevator car doors depending on the location of the elevator car within the elevator shaft.

BRIEF DESCRIPTION OF THE SEVERAL VIEWS OF THE DRAWINGS

The accompanying drawings illustrate various exemplary implementations and are part of the specification. The illustrated implementations are proffered for purpose of example, not for purpose of limitation.

DETAILED DESCRIPTION OF THE INVENTION

In this disclosure, the term "leveling zone" refers to the elevator car doors being at a level that aligns or near aligns with the hoist way doors. It is in the leveling zone that the elevator doors and elevators doors are opened so that passenger can safely enter and/or exit the elevator car.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. The directional terms, including "right," "left," "up," "down," "forward," and "back" are used to describe positions and movement as it pertains to the embodiment described herein to provide clarity of positional relationships and functionality and is not intended to be limiting for other embodiments. As used herein, the singular forms "a," "an," and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
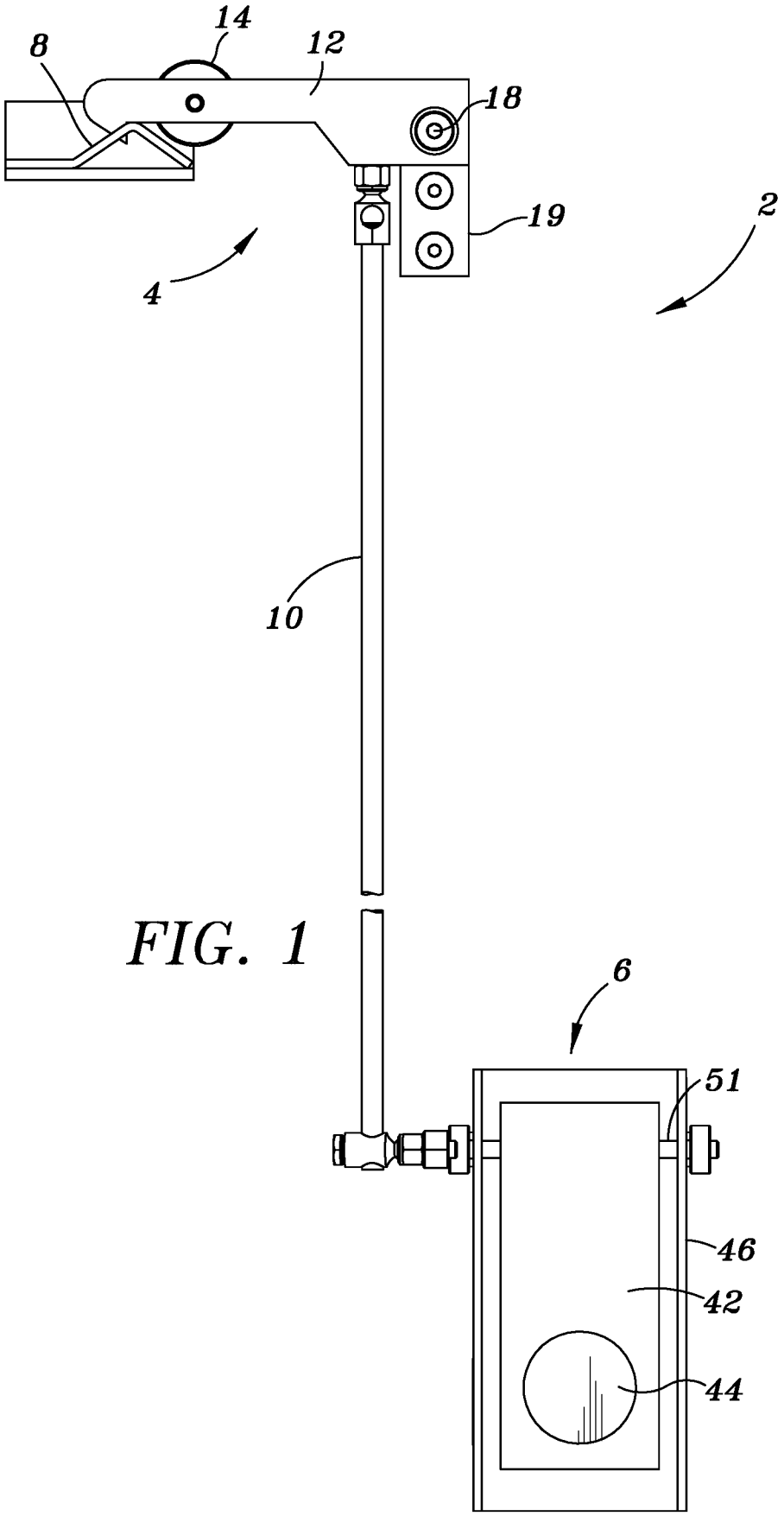
FIG. 1 depicts a front view of a safety mechanism, as shown and described herein.

FIG. 1 depicts a first perspective view of a safety mechanism 2 for an elevator assembly. The safety mechanism 2 can include a beak assembly 4, a lock bar 8, a linkage rod 10, and a detector assembly 6. The linage rod 10 then provides mechanical communication between the beak assembly 4 and the detector assembly 6.

The beak assembly 4 can include a beak 12, a roller 14, a pivot pin 18, a pivot pin receiver 19. The beak 12 can include an elongated body having a first end having a pivot point, wherein a pivot pin 18 allows the beak 4 to rotate about the pivot point. The pivot pin 18 is connected to stationary pivot pin receiver 19, which can be mounted or otherwise attached to a mounting platform or stationary surface. A top end, or first end, of the linkage rod 10 can be connected to a predetermined position on the beak 12 such that longitudinal movement of the linkage rod 10 results in the movement of the beak 4 between a down position and an up position. Similarly, the movement of the beak 4 between a down-position and an up-position results in the longitudinal movement of the linkage rod 10.

As discussed throughout, the safety mechanism 2 is designed such that the position of the linkage rod 10, either in an up-position or a down-position, is predetermined based on the location of the elevator car in relation to a building's floors, or landing zones. At a predetermined landing zone, the linkage rod 10 is systematically guided to an up-position to allow for separation of the beak assembly 4 from the lock bar 8. When the elevator car is away from a predetermined landing zone, the linkage rod 10 is maintained in a down-position so that the beak assembly 4 engages the lock bar 8 to prevent the elevator doors from opening. The landing zones indicate a position of the elevator car where it is safe for the doors of the elevator to open so that patrons can enter or exit the elevator car. When away from a landing zone, it is generally not safe for a patron to enter or exit the elevator car, so the safety mechanism 2 prevents the doors from being opened.

Figure 2:
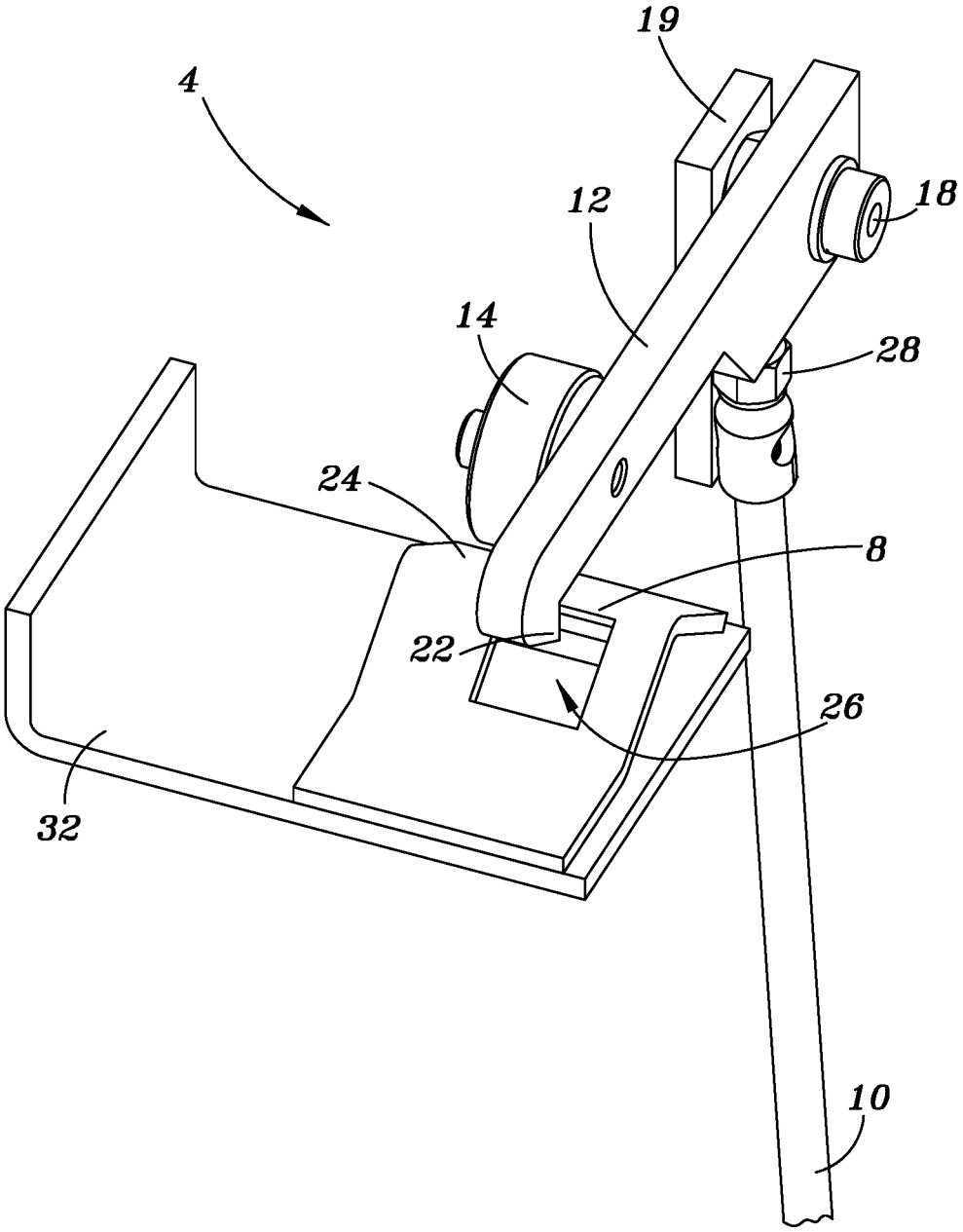
FIG. 2 depicts a perspective view of a beak assembly and a lock bar, as shown and described herein.
Figure 3:
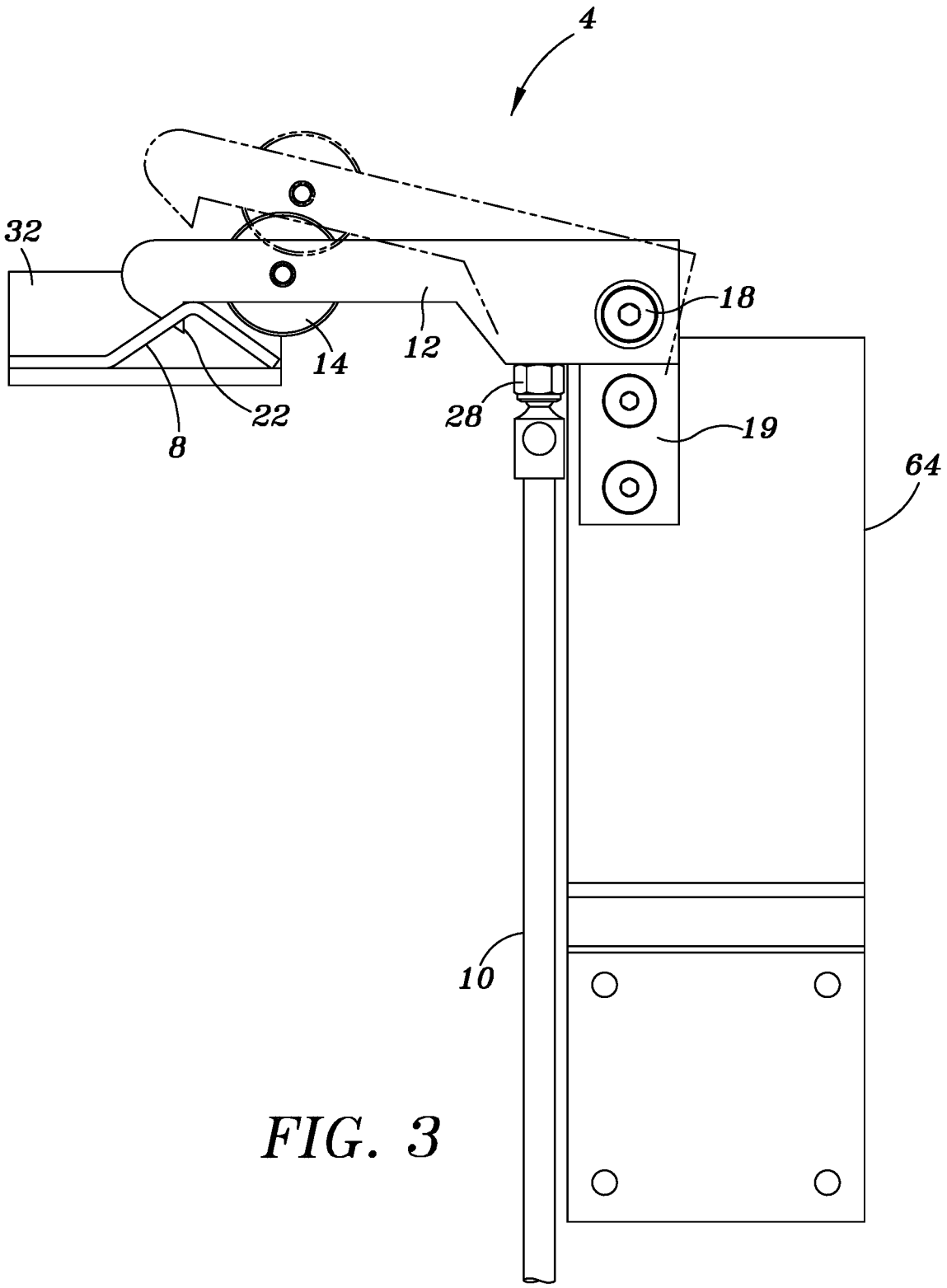
FIG. 3 depicts a front view of the beak assembly and a lock bar, as shown and described herein.

FIG. 2 depicts a perspective view of the beak assembly 4 and lock bar 8 and FIG. 3 depicts a front view of the beak assembly 4 and lock bar 8. The beak's 12 elongated body can have the pivot point 18 about a proximal end, or first end, and a hook 22 about a distal end, or second end. A roller 14 can be disposed about the body of the beak 12 and is configured to move the beak between the up position and the down position as the roller 14 traverses a surface. The roller 14 can be connected to, or otherwise extend from, the beak about a mid-point, the mid-point being a location between the proximal and distal ends of the beak 12.

The lock bar 8 and the beak 12 can move laterally in relation to one another such that the roller 14 "rolls" along the top surface of the lock bar 8. In the embodiment presented, the lock bar 8 can include a ramp shaped portion so that as the roller 14 traverses the surface of the lock bar 8, the beak is moved upward and downward at predetermine portions of the lock bar's 8 surface.

The hook 22 is configured to engage a catch 26 in the lock bar 8. The catch 26 prevents further lateral movement of the beak 12 when the beak assembly 4 is moving away from the lock bar 8. As shown, the catch 26 can be a hole disposed in a portion of the lock bar 8. As the beak traverses the lock bar 8, presented as the beak assembly moving from left to right, the roller 14 directs the beak 12 up and over the ramp 24 portion of the lock bar 8. As the roller moves across a portion of the ramp 24, the hook engages the catch 26, preventing further rightward movement of the beak assembly 4. As shown, moving from left to right the roller 14 moves across a first, or upward, portion of the ramp 24 and then across a second, or downward, portion of the ramp 24. As the roller 14 moves downward, it brings the beak 12 downward such that the hook 22 of the beak 12 catches in the hole 26 of the first portion of the ramp 24. Once caught in the hole 26, the beak 12, and the rest of the beak assembly 4, is no longer able to continue rightward movement, away from the lock bar 8. The size, shape, and configuration or the beak, its hook 22 and catch 24, and their engagement with one another, can have a variety of embodiments.

The lock bar 8 can be disposed on or extend from a lock bar mount 32. The lock bar mount 32 provides structural integrity to the lock bar 8 and provides a means for fixing the lock bar 8 to the elevator.

Referring to FIG. 3, a raised beak 12 will miss the catch 24 as the beak assembly 4 moves laterally away from the lock bar 8 and a lowered beak 12 will engage the catch 24 to prevent additional lateral movement of the beak assembly 4 away from the lock bar 8. The movement of the beak 12 between the up position and the down position can be caused by the corresponding movement of the linkage rod 10. The linkage rod 10 is connected to the beak 12 at a connection point 28. The connection point 28 can have a variety of embodiments, shown here as male/female threaded connection. The linkage rod 10 connection point 28 can be on or about the body of the beak 12 and at a position appropriate to affect the raising and lowering of the beak 12 about the pivot point 18.

The pivot point 18 can include a bearing type assembly fixed to a pivot pin receiver 19. The pivot pin receiver 19 can be a fixed point and support the position and movement of the beak assembly 4. As shown, the pivot pin receiver can include a mounting portion which can be connected to a beak assembly mount 64. The beak assembly mount 64 can be mounted to the door of the elevator such that movement of the elevator door results in the movement of the beak assembly from left to right and, notably, movement of the beak 12 in relation to the lock bar 8.

Figure 4:
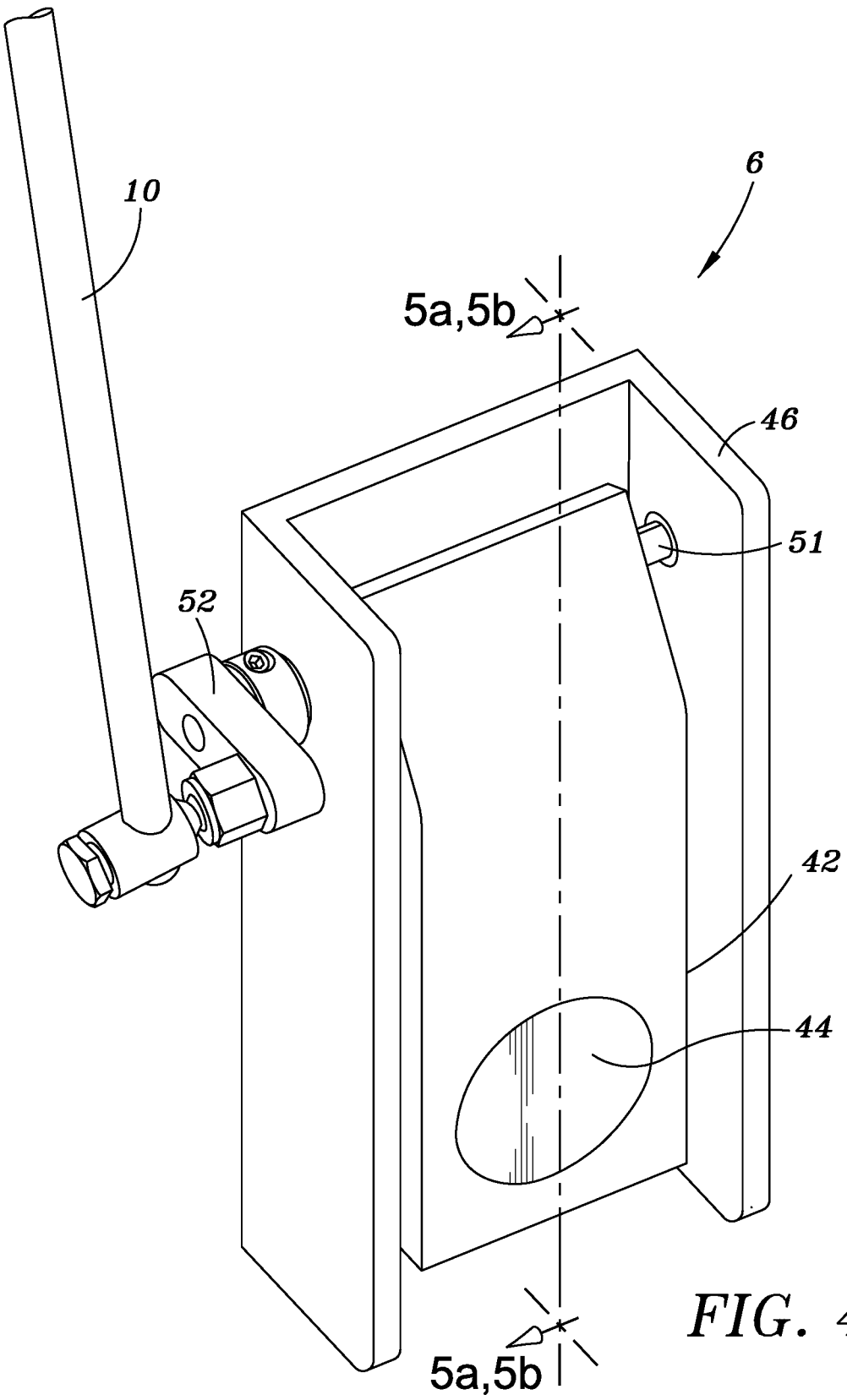
FIG. 4 depicts a perspective view of a detector assembly, as shown and described herein.

FIG. 4 depicts the detector assembly 6. The detector assembly 6 can include a detector arm 42, a detector magnet 44, a shaft 51, and a detector housing 46. A top end, or first end, of the detector arm 42 can be attached to the shaft 51 such that rotation of the shaft 51 results in movement of the detector arm 42 and movement of the detector arm results in the rotation of the shaft 51. The shaft 51 can be connected, directly or indirectly, to a bottom end, or second end, of the linkage rod 10 such that the longitudinal movement of the linkage rod 10 results in the movement of the detector arm 42 between a forward position and a back position. Similarly, the move movement of the detector arm 42 between a forward position and a back position results in the longitudinal movement of the linkage rod 10.

The detector assembly 6 can also include a pivot transfer component 52 connecting the lower end of the linkage rod 10 to the shaft 51. The pivot transfer component 52 provides a means for converting the rotational movement of the shaft to up and down movement of the linkage rod 10. As shown, the shaft 51 can extend into a first end of the pivot transfer component 52 and serves as the pivot point for the pivot transfer component 52, with the lower end of the linkage rod 10 connected to a second end of the pivot transfer member 52 such that the rotation of the pivot transfer component 52 affects the rotation of the shaft 51 and the longitudinal movement of the linkage rod 10. IN one or more embodiments, the shaft 51 and/or the pivot transfer component 52 can include one or more components (i.e., stops) to prevent the detector arm 42 from moving further forward and/or further backwards than desired.

The detector housing 46 can include one or more walls or sides to house and otherwise protect the components of the detector assembly from interference or damage. The housing 46 can also provide means for mounting the detector assembly 6 to the elevator car, namely, the exterior of the elevator door. One or more mounting brackets 66 (four are shown) can extend from the housing 46 and one or more fasteners can secure the housing to the elevator car.

Figure 5A:
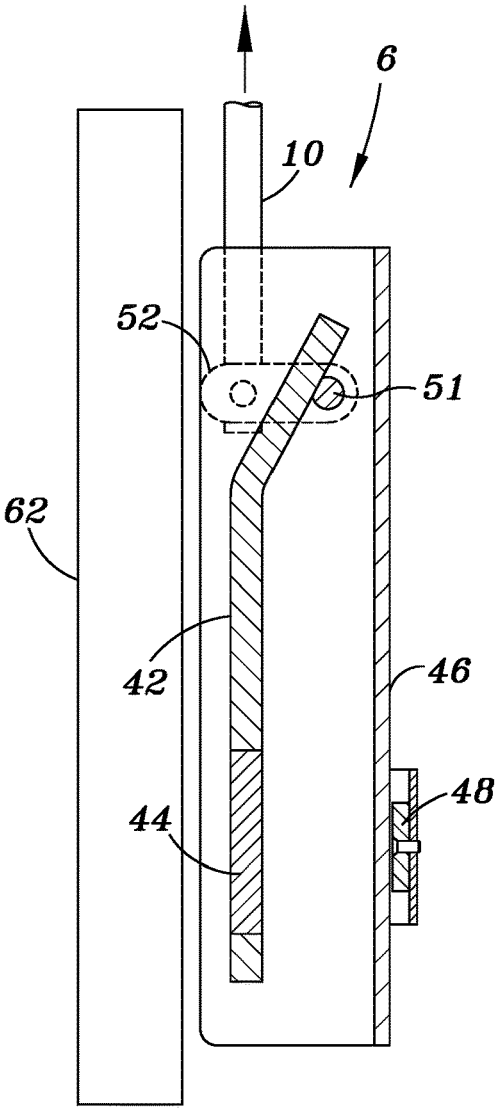
FIG. 5*a* depicts a side cross-sectional view of the detector assembly at a target zone, as shown and described herein.
Figure 5B:
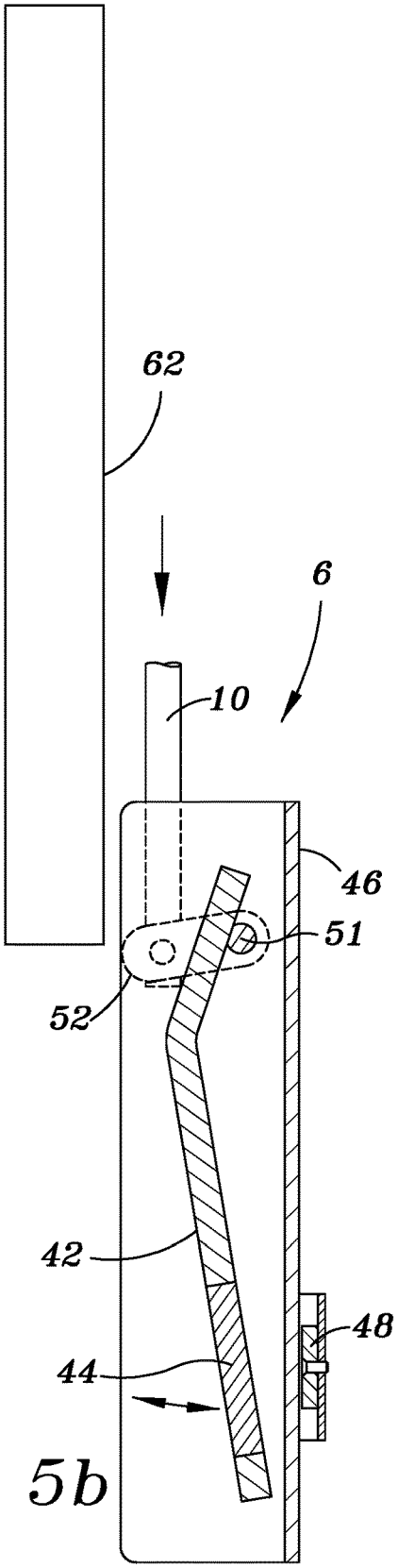
FIG. 5*b* depicts a side cross-sectional view of the detector assembly away from the target zone, as shown and described herein.

FIG. 5*a* depicts the detector assembly at a target zone 62 and FIG. 5*b* depicts the detector away from a target zone 62. Referring to FIG. 5*a*, when the detector assembly is aligned with a target zone 62, the detector arm 42 can be moved to a forward position. As disclosed herein, the detector magnet 44 disposed on the detector arm 42 can attract to a corresponding magnetic property of the target zone 62. The magnetic properties of the target zone 62 can include more or more magnets or, alternatively, the target zone 62 can be or include a length of metal having magnetic properties (i.e., iron). One or more of the components of the detector assembly 6 can be set so that the detector arm 42 does not actual make physical contact with any portion of the target zone 62. This "no contact" relationship allows the safety mechanism to work efficiently and quietly, reducing the risk of mechanic interference at the landing zone and reducing the noise of elevator components during operation. Positioning the detector arm 42 and the distance necessary to cause the contactless interaction can require some adjustment on the detector mechanism 6 components and the target zone 62 components during installation of the safety mechanism.

Referring to FIG. 5*b*, when the detector assembly is not aligned with a target zone 62 and no magnetic force exists between the detector magnet 44 and the target zone 62, the detector arm 42 is maintained at a back position. Similar to the no-contact interaction between the detector arm 42 and the target zone 62, it is desirable to have the detector magnet 44 and the offset magnet 48 positioned so that the detector arm 42 does not contact the rear surface of the detector housing 46. Preventing contact of the detector arm 42 with the target zone 62, the housing cover 65 (presented in FIGS. 6*a-b*), and any surface of the detector housing 46 prevents wear and tear on the components and eliminates noise during operation.

As the detector assembly 6 comes into alignment with a target zone 62, the forward movement of the detector arm 42 results in the raising of the linkage rod 10. As the detector assembly 6 comes out of alignment with the target zone 62, the falling back of the detector arm 42 results in the lowering of the linkage rod 10.

An offset magnet 48 can be mounted about the back of the housing 46 and positioned such that it interacts with the detector magnet 44. More particularly, the offset magnet 48 can be of a strength or placed in such a position as to maintain the detector arm 42 at a predetermined position. As suggested in FIG. 5*b*, the offset magnet 48 can be positioned in line with the detector magnet 44 and can be magnetically opposite, or having a polar opposite, such that the detector magnet 44 and the offset magnet 48 repel one another. The repelling forces can hold the detector arm 42 at a predetermined position within the housing 46. The "predetermined position" is intended to be the "back position" of the detector arm 42 when it is not engaging the target zone 62. The ability of the offset magnet 48 to magnetically hold the detector arm 42 in a predetermined position greatly enhances the operation and usability of the safety mechanism 2. The offset magnet 48 can be adjusted in a variety of ways to increase or decrease its influence on the detector magnet 44. For example, the offset magnet 48 can be moved upward or downward in relation to the detector magnet 44 to adjust the detector arm 42 forward or backward. In another example, the offset magnet 48 can be mounted to a threaded member and moved toward or away from the detector magnet 44 to adjust the detector arm 42 forward or backward.

The safety mechanism 2 provided herein is intended to be versatile, adjustable, and capable of working effectively on elevators of many shapes, sizes, styles and varieties. Adjustability and the customized fit of the safety mechanism 2 can be accomplished by adjusting one of several components of the safety mechanism 2 as well as the mounts and brackets used to connect the safety mechanism to the elevator.

Figure 6A:
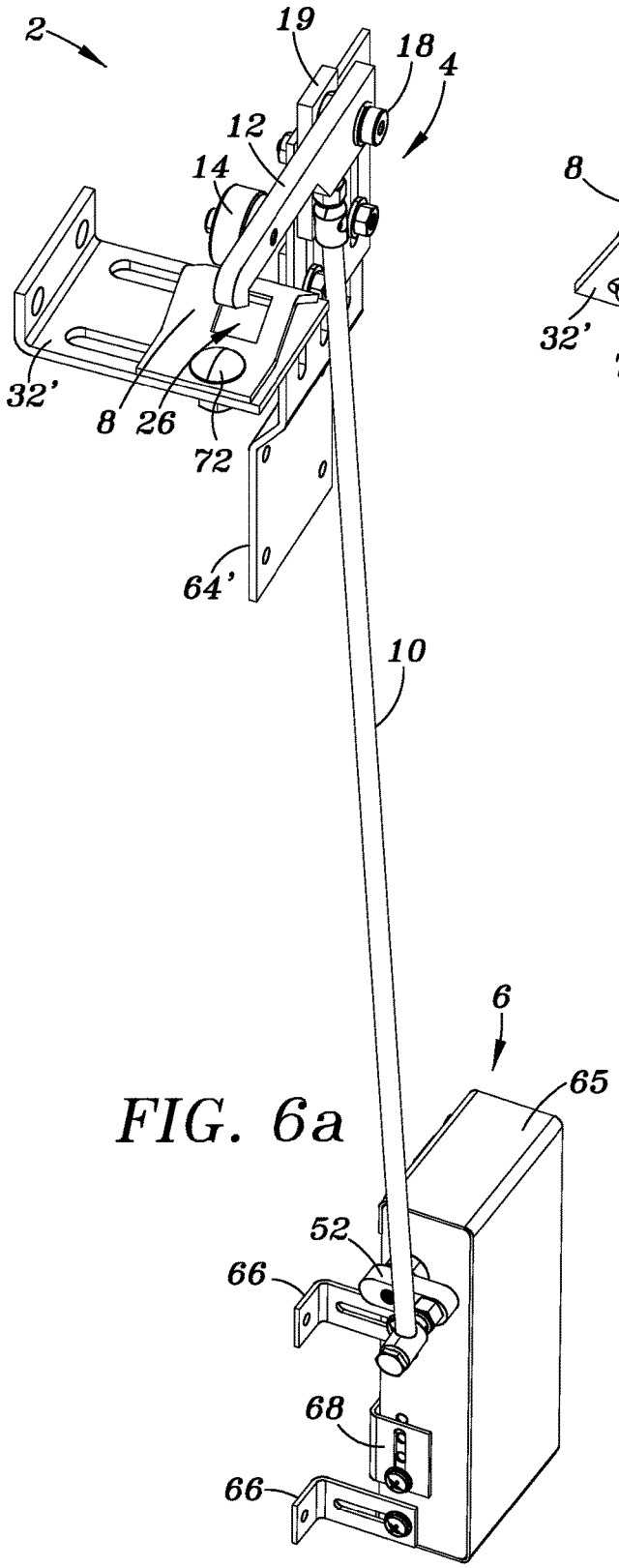
FIG. 6*a* depicts a first perspective view of the safety mechanism with mounting brackets, as shown and described herein.
Figure 6B:
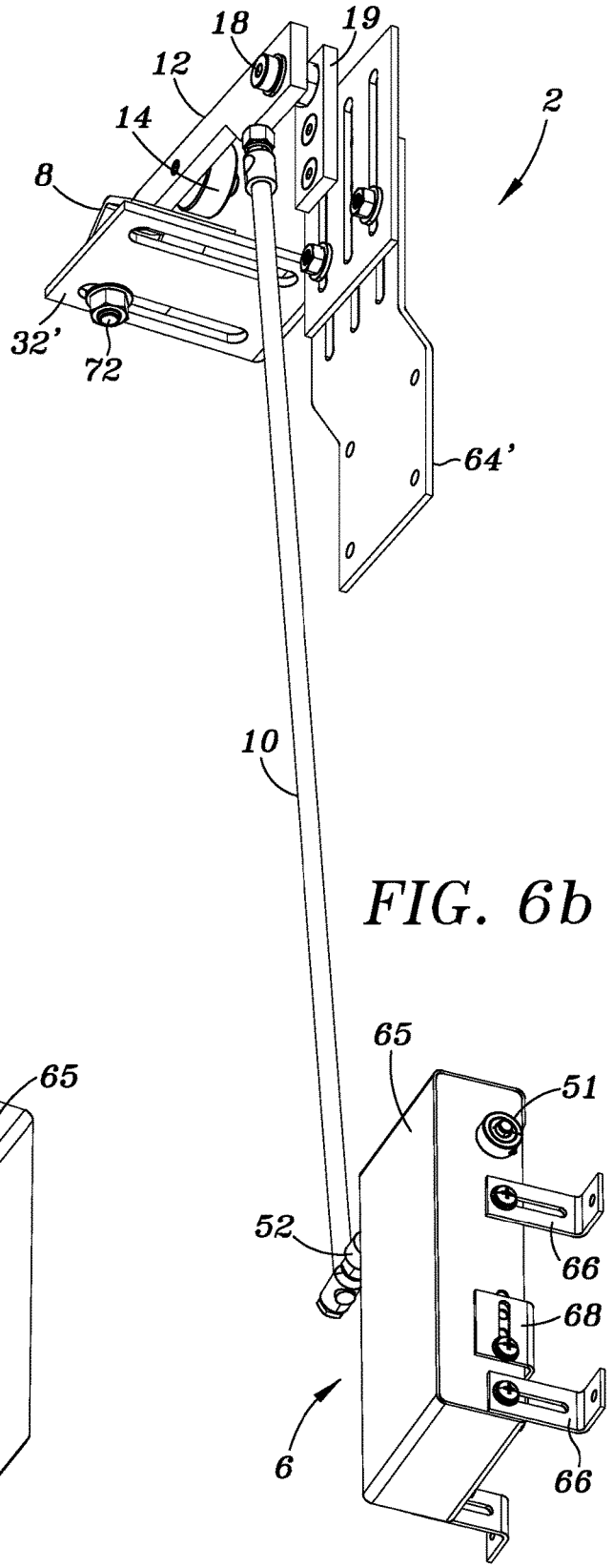
FIG. 6*b* depicts a second perspective view of the safety mechanism with mounting brackets, as shown and described herein.

FIGS. 6*a* and 6*b* depict first and second perspective views of the safety mechanism 2 with adjustable mounts. The lock bar 8 can be disposed on or directly connected to a lock bar mount 32' via one or more fasteners 72. As shown, the lock bar mount 32' can include a first portion having one or more slots so that position of the lock bar 8 can be adjusted in relation to the lock bar 8 and to the beak 12. A second portion of the lock bar mount 32' can include one or more connection points for connecting the lock bar mount 32' to the elevator.

The beak assembly mount 64' can also have adjustable components. For example, the beak assembly mount 64' can include a first piece and a second piece connected to one another an containing adjustable bracket connections. The beak assembly mount 64' can also include an elongated bracket for connecting to the pivot pin receiver 19 such that the beak assembly 4 can be attached to and otherwise adjusted in its position about the beak assembly mount 64'.

The detector assembly 6 can include a variety of adjustable mounts 66 and can also include a housing cover 65 to guard or otherwise protect the components of the detector assembly 6 within the housing 46. Considering the magnetic features and interaction of the detector arm 42 and the target zone 62, the housing cover 65 can be made of a non-magnetic material.

Figure 7:
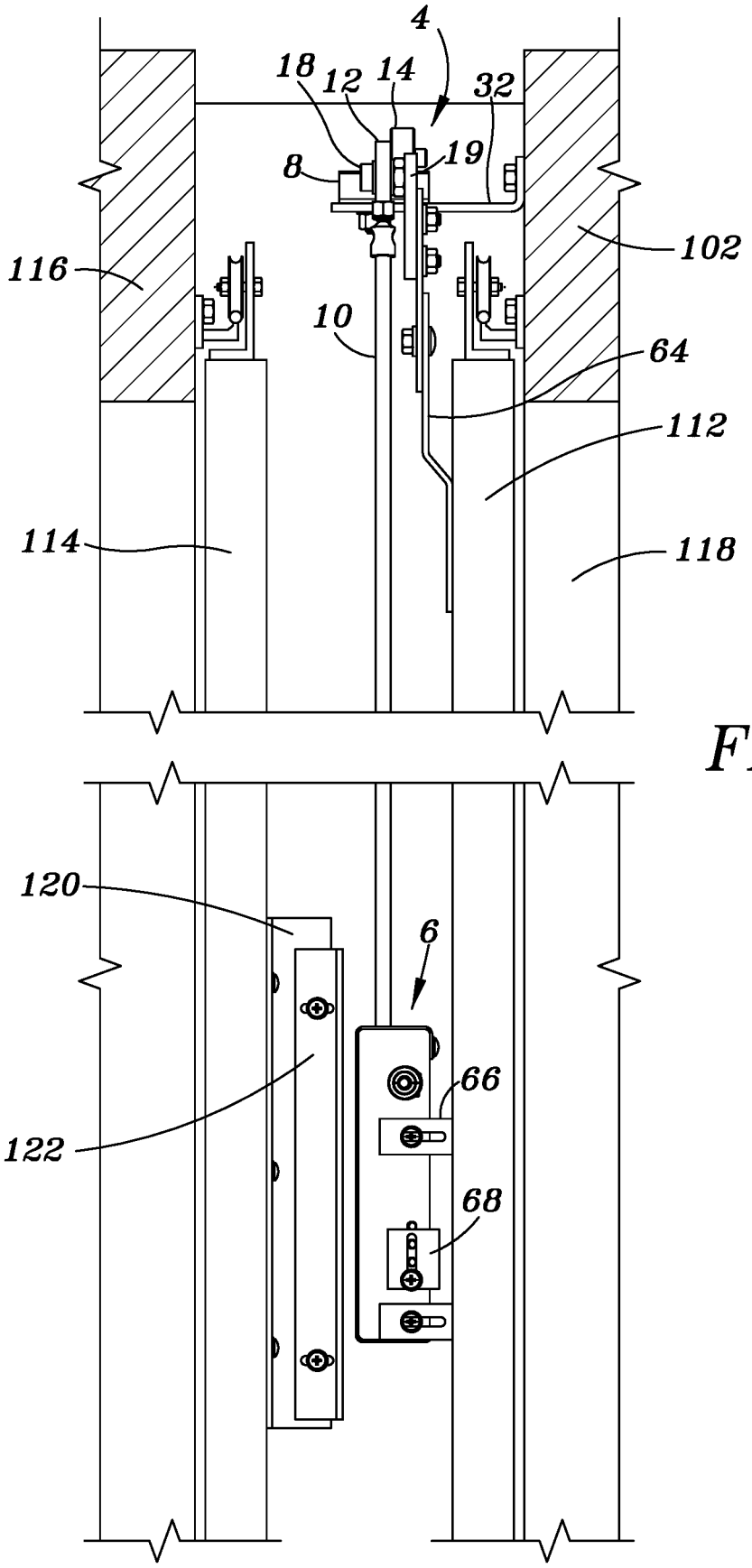
FIG. 7 depicts a front view of the safety mechanism used in context, as shown and described herein.

FIG. 7 depicts the safety mechanism 2 in context, with components mounted to about the elevator car 102 and positioned between the elevator car 102 and the hoist way 116 and hoist way doors 114. The lock bar 8, via the lock bar mount 32, can be connected to a surface of the elevator car 102 above the elevator door(s) 112. The beak assembly 4, via the beak assembly mount 64, can be connected to the elevator door 112. As shown, the beak assembly 4 can be mounted at a position for optimal interaction with the lock bar 8, for the reasons discussed herein.

The detector assembly 6 can be mounted about the elevator door 112 and, as shown, at a position generally below the beak assembly 4. The target zone 122 can be mounted to the hoist way door 114, via the target zone mount 120, at a position corresponding to the detector assembly 6 position, such that when the elevator door(s) 112 reaches the floor level and begins to open, the detector arm 42 of the detector assembly 6 reacts to, or magnetically couples, with the target zone 122 as the elevator door(s) 112 are opened to expose the internal volume of the elevator car 102 at the selected floor level.

Figure 8:
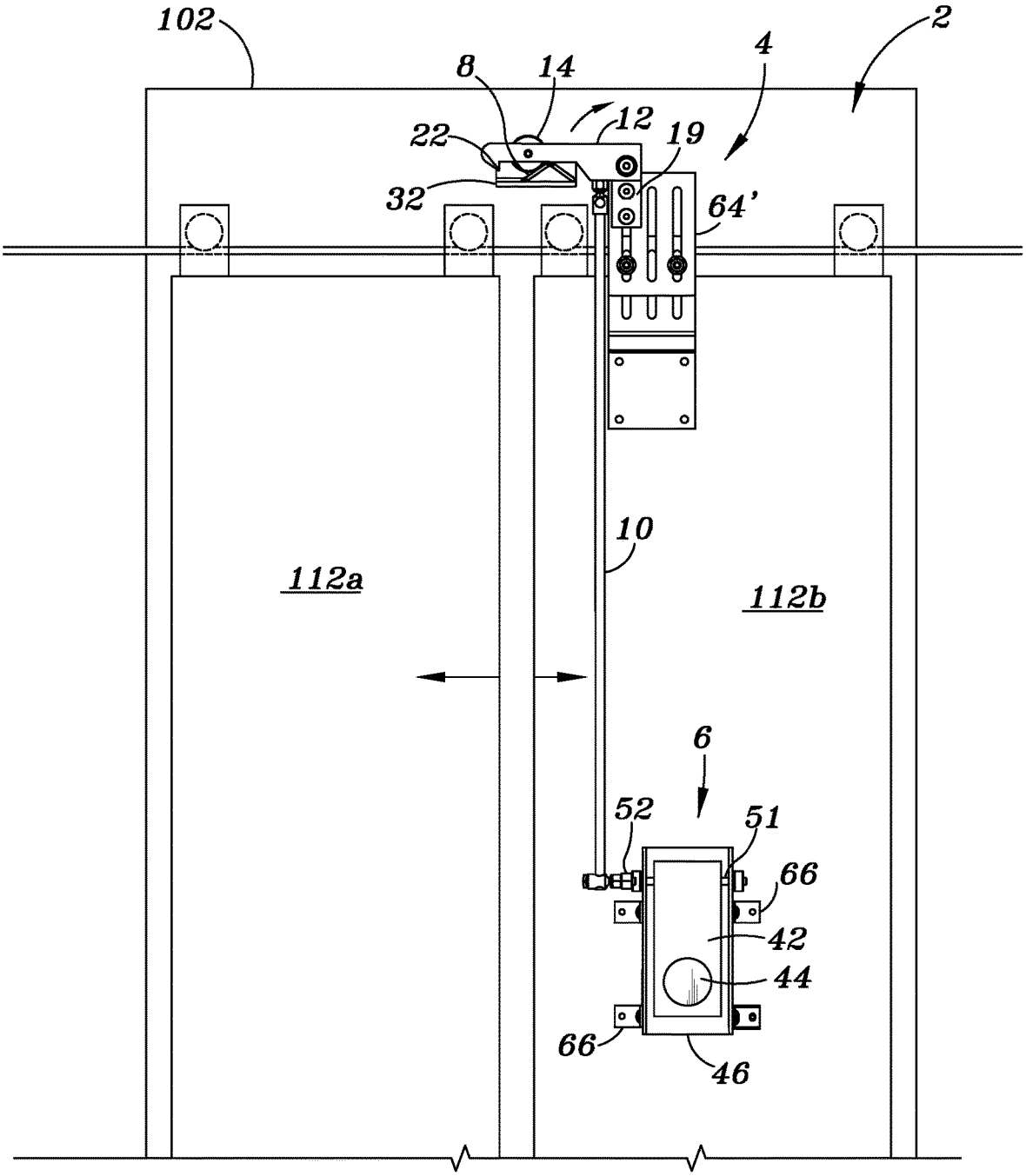
FIG. 8 depicts a side view of the safety mechanism used in context, as shown and described herein.
Figure 9:
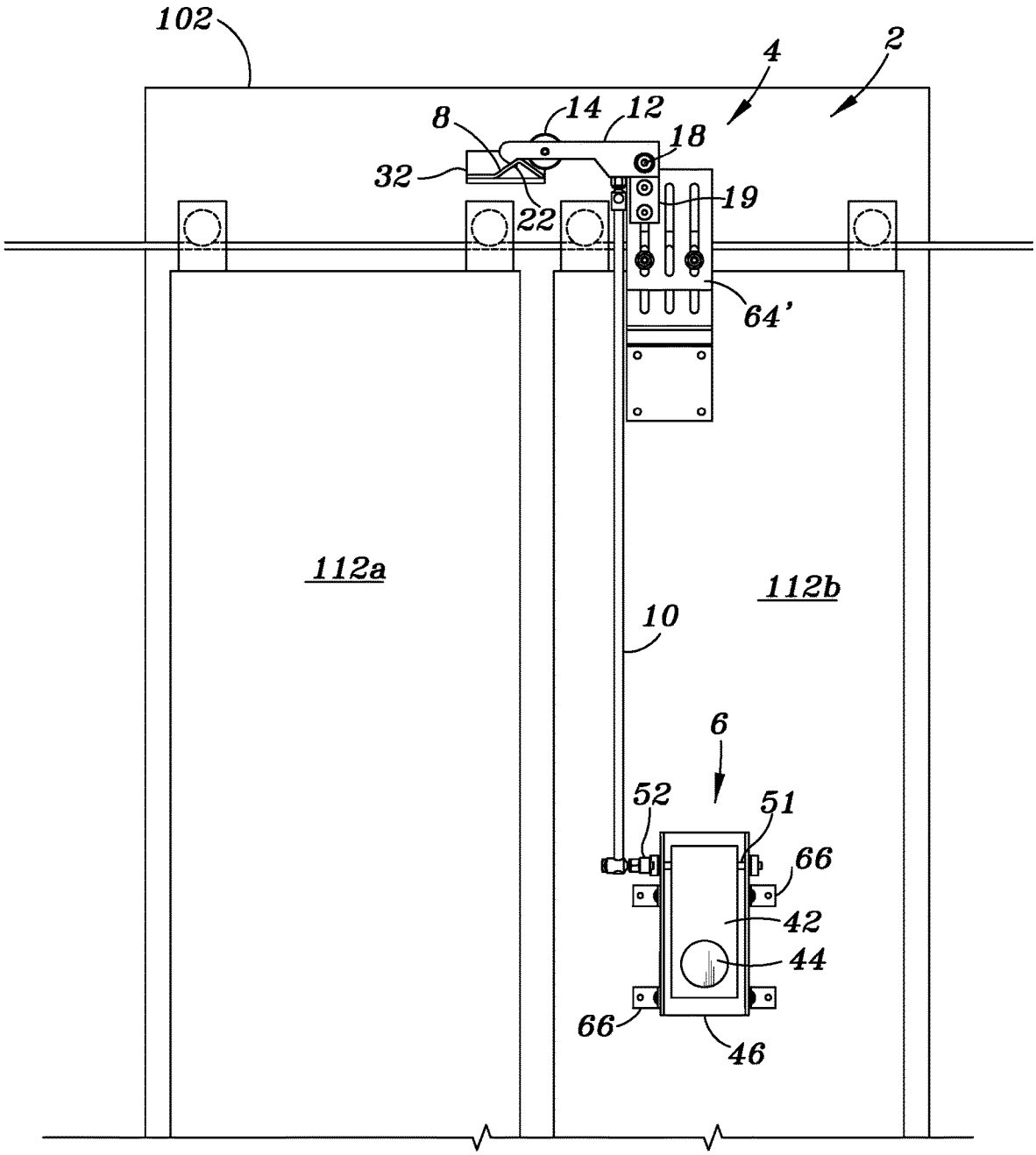
FIG. 9 depicts another front side view of the safety mechanism used in context, as shown and described herein.
Figure 10:
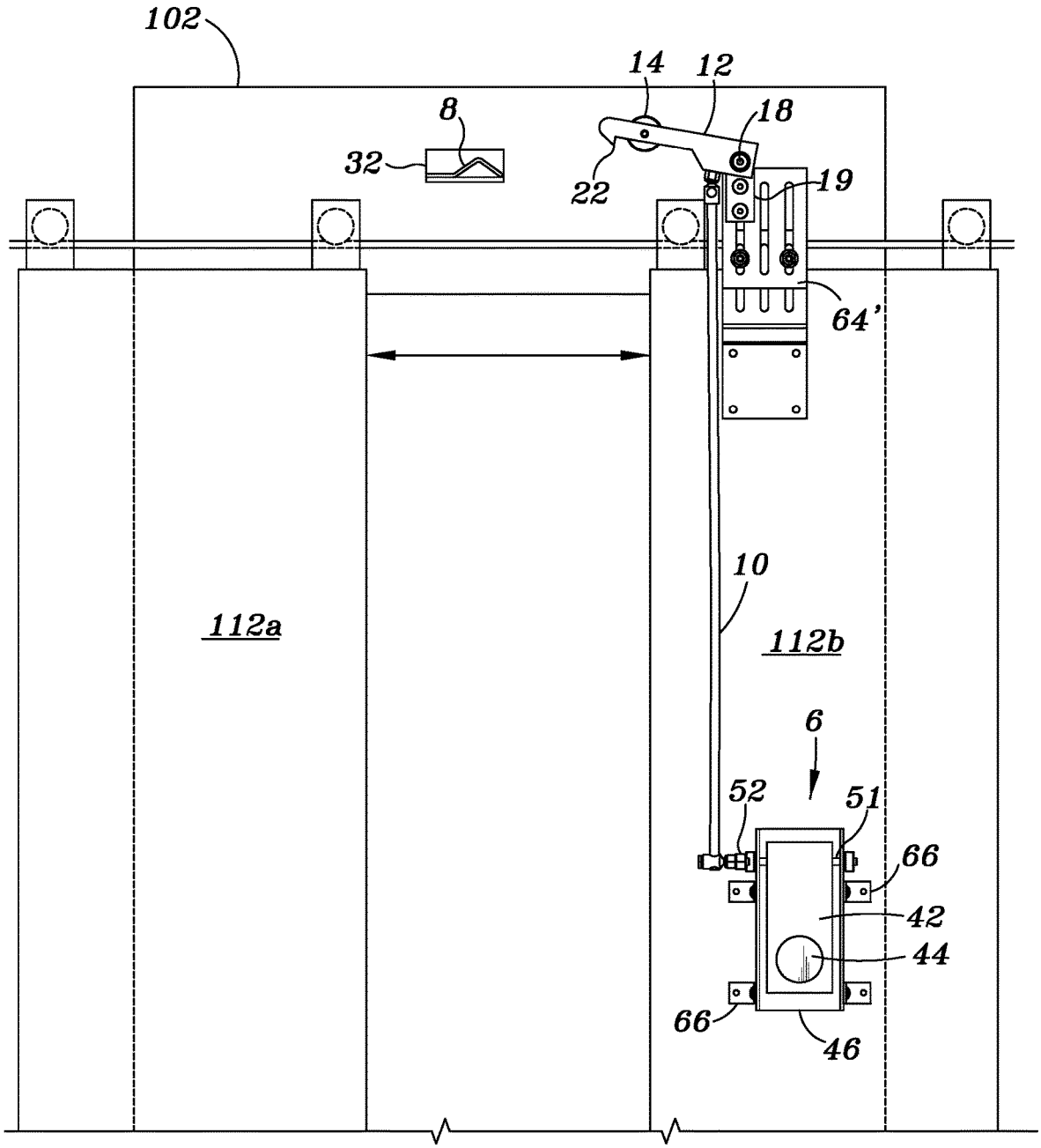
FIG. 10 depicts another front side view of the safety mechanism used in context, as shown and described herein.

FIGS. 8 through 10 depict the safety mechanism 2 in use on a two-door elevator car 102, having a left door 112*a* and a right door 112*b*, where the doors connect/abut about the center when the elevator car doors 112*a-b* are in a closed position. As shown, the lock bar 8, via the lock bar mount 32, is connected to the outer surface of the elevator car 102 at a position above the elevator car doors 112*a-b*. The beak assembly 4 is mounted, via the beak assembly mount 64', to the second car door 112*b* so that it moves leftward and away from the lock bar 8 as the elevator doors 112*a-b* open and rightward and toward the lock bar 8 as the elevator doors 112*a-b* close. The beak assembly 4 is also positioned so that the roller 14 can traverse the top surface of the lock bar 8 as the car doors 112*a-b* open and close. The detector assembly 6 can be mounted on the second car door 112*b* and at a position generally below the beak assembly 4 so that the linkage rod 10 can effectively relay communication/movement between the detector assembly 6 and the beak assembly 4. The linkage rod 10 can be connected to the beak 12 and the detector arm 42 (via the shaft 51 and/or the pivot transfer component 52) so that when the detector arm 42 moves between the forward position and the back position the beak 12 is moved between the down position and the up position. Similarly, when the beak 12 is moved between the down position and the up position (possibly via the roller 14 reacting the top surface of the lock bar 8 as it traverses that surface) the detector arm 42 is moved between the forward position and the back position.

FIG. 8 depicts the safety mechanism 2 in a hold position with the doors of the elevator 112*a-b* closed or nearly closed. The "hold position" is the collective position of the elevator car doors 112*a-b* and the safety mechanism 2 when the elevator car doors are closed. The hold position is generally maintained when the elevator 102 is in motion (moving between floors) or is sitting dormant at a floor. In the hold position, the detector assembly 6 is not engaging a target zone 62 and the hook 22 of the beak assembly 4 is not engaging the catch 24 of the lock bar 8. In the embodiment shown herein, the beak 12 is maintained in the down position while in the hold position and the detector arm 42 is maintained in the back position when in the hold position.

The safety mechanism 2 and elevator 102 can move out of the hold position when the doors of the elevator 112*a-b* are opened, which generally occur under two circumstances. First, when the elevator car 102 is away from the floor zone and a patron attempts to open the elevator doors 112*a-b*, usually from inside the elevator car 102. Second, when the elevator car 102 is at a floor zone and the doors 112*a-b* are opened and/or closed to allow patrons to enter and/or exit the elevator car 102.

FIG. 9 depicts the safety mechanism 2 in a locked position, which occurs when the elevator car 102 is away from the floor zone and a patron attempts to open the elevator doors 112*a-b*, usually from inside the elevator car 102. As the patron begins forcing the doors open, generally accomplished by pushing his hands between the doors 112*a-b* and pushing outward, the beak 12 remains in a down position. With the beak 12 in the down position, the roller 14 traverses the top surface of the lock bar 8 and guides the hook 22 of the beak 12 to engage the catch 24. Once engaged, the beak 12, along with the rest of the safety mechanism 2 and the door(s) 112*a-b*, can not continue its motion. The doors 112*a-b* are prevented from opening further. When the beak 12 is in the down position, the safety mechanism 2 is in the "closed configuration."

FIG. 10 depicts the safety mechanism in an unlocked position, which occurs when the detector arm 42 engages the target zone 62. When the detector arm 42 engages the target zone 62 such that the detector arm 42 is moved to the forward position, the linkage rod 10 is raised causing the beak 12 to raise to the up position. In the up position, the hook 22 of the beak 12 will not engage the catch 24 of the lock bar 8, allowing to doors 112*a-b* to open completely and the safety mechanism is in the "open configuration." The beak 12 will remain in the up position so long as the detector magnet 44 is magnetically coupled to the target zone 62.

At the landing zone, the doors of the elevator are opened, and patrons are able to enter and/or exit the elevator car 102. Once the elevator doors 112*a-b* close and the detector arm 42 disengages from the target zone 62 and moves to the back position, the beak 12 returns to the down position, as shown in FIG. 8, until the doors are opened or attempted to be opened again.

Even if there is a misalignment or distance difference between the elevator door and the landing/hoist way door, the magnetic attraction between the detector magnet 44 and the target zone 62 will still work as long as it is "close enough." This allows for a little larger margin of error for installers and mechanics. Also, there is significantly less noise because of the lack of contact.

FIGS. 5*a* and 5*b* seemingly indicate that the detector assembly 6 engages and disengages the target zone 62 by vertical movement of the detector assembly 6 attached to the elevator car 102. This would require that the detector assembly 6 be mounted to the elevator car such that it is vertically in line with the target zone 62 at every floor of the building. Such an alignment would cause the detector arm 42 to react to every target zone 62 it passes, even on floors that the elevator is not stopping at. This could cause unnecessary work of the safety mechanism 2 and a knocking noise caused by the up and down motion of the beak 12 engaging and disengaging the top surface of the lock bar 8.

An alternative option is to offset the target zone 62 at each landing zone so that the target zone 62 is not engaged by the detector arm 42 until the doors 112*a-b* are slightly opened. More specifically, the detector assembly 6 does not align with target zone 62 as the elevator car 102 lands at a selected floor. The elevator doors 112*a-b* begin to open, moving the beak 12 toward the catch 24 on the lock bar 8. However, before the catch 24 is engaged by the beak 12, the detector assembly aligns with and engages the target zone 62 so that the detector arm 42 is moved forward raising the beak 12 to the up position. In the up position, the beak 12 will not engages the catch 24 as it passes, allowing the doors to fully open. In reference to the figures, the target can be from about 1 inch to about 6 inches to the right of the detector assembly 6 at a landing zone.

Because two-door elevators systems almost always including a linkage cable or mechanism linking the two doors together, so that one door cannot move independently of the other, the safety mechanism often only needs to be mounted and configured to control the movement of one of the doors. In other embodiments however, any one or more components of the safety mechanism can be altered in size and shape and/or can be duplicated to provide a customized system for any type of elevator.

Although the present invention has been described with respect to specific details, it is not intended that such details be regarded as limitations on the scope of the invention, except to the extent that they are included in the accompanying claims. It will thus be appreciated that those skilled in the art will be able to devise numerous alternative arrangements that, while not shown or described herein, embody the principles of the invention and thus are within its spirit and scope.

I claim:

1. An elevator safety mechanism, comprising:

a lock bar comprising a catch, wherein the lock bar is mounted to a top portion of an elevator car;

a beak assembly comprises a beak having a pivot point about a proximal end of the beak and a hook about a distal end of the beak, wherein the beak assembly is mounting to an elevator door;

a detector assembly comprises a detector arm having a detector magnet, wherein the detector assembly is mounted to the elevator door, wherein the detector arm moves to a forward position when the detector magnet is attracted to a target zone, and wherein the movement of the detector arm to the forward position results in the movement of the beak to a down position; and a linkage rod relaying movement between the detector assembly and the beak assembly.

2. The elevator safety mechanism of claim 1, wherein when the safety mechanism is in a closed configuration, the beak engages the catch as one or more doors of the elevator car are opened.

3. The elevator safety mechanism of claim 2, wherein when the hook engages the catch, the one or more elevator doors cannot open further.

4. An elevator safety system, comprising:

a lock bar comprising a catch;

a linkage rod relaying movement between a beak assembly and a detector assembly, the beak assembly comprises a beak with a hook for engaging the catch, wherein longitudinal movement of the linkage rod results in the movement of the beak between a down position and an up position, and the detector assembly comprises a detector arm, wherein movement of the detector arm between a forward position and a back position results in longitudinal movement of the linkage rod;

a magnetic target zone mounted to a hoist way door, wherein the target zone moves the detector arm to the forward position; and an offset magnet mounted about a rear side of the detector arm, wherein the offset magnet determines the detector arm's position when the detector assembly is away from the target zone.

5. The elevator safety system of claim 4, wherein the beak pivots between the up position and the down position about a pivot point.

6. The elevator safety system of claim 4, wherein a roller extends from the beak about a midpoint and wherein the roller guides the beak over a top surface of the lock bar surface.

7. The elevator safety system of claim 4, wherein a roller extends from the beak about a midpoint and wherein the roller guides the hook to the catch when the beak is in the down position.

* * * * *